US006127936A

United States Patent [19]

Gendel et al.

[11] Patent Number: 6,127,936

[45] Date of Patent: Oct. 3, 2000

[54] APPARATUS FOR AND METHOD OF PROVIDING AN INDICATION OF THE MAGNITUDE OF A QUANTITY

[75] Inventors: Alon Gendel, Ra'anana; Oren Eliezer, Kfar Saba, both of Israel

[73] Assignee: Texas Instruments Isreal Ltd., Kfar Saba, Israel

[21] Appl. No.: 09/196,958

[22] Filed: Nov. 20, 1998

[51] Int. Cl.[7] ..... G08B 25/08

[52] U.S. Cl. ..... 340/692; 340/514; 340/539; 455/154.1; 455/156.1; 455/157.2

[58] Field of Search ..... 340/326, 327, 340/328, 329, 331, 332, 573.4, 573.1, 692, 460, 511, 514, 539, 515; 455/67.7, 154.1, 154.2, 156.1, 157.2

[56] References Cited

U.S. PATENT DOCUMENTS

| | | | |
|---|---|---|---|
| 4,137,499 | 1/1979 | Caudel | 325/67 |
| 4,183,025 | 1/1980 | Kutaragi et al. | 324/103 P |
| 4,348,666 | 9/1982 | Ogita | 340/753 |
| 4,356,393 | 10/1982 | Fayfield | 250/214 R |
| 4,603,325 | 7/1986 | Marino et al. | 340/539 |
| 4,754,261 | 6/1988 | Marino | 340/514 |
| 5,630,210 | 5/1997 | Marry et al. | 455/67.3 |
| 5,903,237 | 5/1999 | Crosby et al. | 342/359 |
| 5,923,288 | 7/1999 | Pedlow, Jr. | 342/359 |
| 5,960,335 | 9/1999 | Umemoto et al. | 455/226.2 |
| 6,011,487 | 1/2000 | Plocher | 340/825.49 |

*Primary Examiner*—Daniel J. Wu
*Assistant Examiner*—Toan Pham
*Attorney, Agent, or Firm*—Darby & Darby

[57] ABSTRACT

An apparatus for and a method of providing a visual and/or audible indication of a numerical quantity. The quantity may be derived from any source such as an analog or digital quantity. The invention has utility in any application wherein it is desirable to visually and/or audibly display the magnitude of a quantity. An example system is described which provides a visual and/or audible indication of the received signal strength (RSSI) in an RF receiver. A visual indicator such as an LED is flashed a number of times corresponding to the magnitude of an input signal. Alternatively, or in combination, an audible indicator such as a buzzer can be beeped a number of times corresponding to the magnitude of the input signal. A digitized quantity to be indicated can be calculated by or input to a microcontroller or other processor that is suitably programmed to convert the magnitude of the digitized quantity to a number representing the number of flashes or beeps. An analog quantity can be digitized by an external A/D converter or by an A/D converter integral with the microcontroller.

26 Claims, 3 Drawing Sheets

APPARATUS FOR AND METHOD OF PROVIDING AN INDICATION OF THE MAGNITUDE OF A QUANTITY

FIELD OF THE INVENTION

The present invention relates generally to display devices and more particularly relates to an apparatus for and method of displaying the magnitude of a quantity as a consecutive sequence of pulses of either light or sound.

BACKGROUND OF THE INVENTION

In many analog and digital communication systems a single indicator such as a light emitting diode (LED) or similar device provides a visual indication that a data packet transmitted from the transmitting end (either wirelessly or through other media) was validly received at the receiving end. Usually, the visual indicator blinks once for valid reception and does not give any indication of the degree or magnitude of any measurable analog or digital quantity, such as a quantity associated with the reception level.

In many applications, however, such as a wireless security system installed in an indoor environment, it is of interest to provide a further indication as to the quality of the reception or other analog quantity. In the example of a security system, this is important especially when the system is being installed and the optimal placement of the many wireless sensors in terms of reception quality must be determined. It is desirable to provide a user or installer of such a system a visual indication means by which the reception quality, i.e., quality of transmission, can be discerned in a simple and inexpensive manner. Providing this visual indication means permits the user or installer to quickly place a sensor in an optimal location within the area the sensor is to be installed.

SUMMARY OF THE INVENTION

The present invention is an apparatus for and a method of providing a visual and/or audible indication of a numerical quantity. The quantity may be derived from any source such as an analog or digital quantity. The invention has utility in any application where it is desirable to visually and/or audibly display the magnitude of an analog quantity or a measure of quality. To aid in illustrating the principles of the present invention, the operation of the apparatus and method of the present invention will be described in the context of a wireless RF security system. Note that this is presented only as an example and is not intended to limit the scope of the present invention, as the principles described hereinbelow enable one skilled in the electrical arts to apply the principles of the present invention to other applications as well.

The example system described herein is an apparatus for and method of providing a visual and/or audible indication of the received signal strength in a receiver. This quantity is commonly termed the receive signal strength indication (RSSI) in the RF field and is an indication of the level of the received signal at the receiver. The magnitude of the RSSI is conveyed to a user via one or more annunciations of the indicator. Note that a digital receiver may limit this indication to valid receptions (as determined by their contents) so as not to provide level indications which are caused by the reception of interference.

The wireless security application example context in which the present invention is described, typically comprises a plurality of transmitting devices, e.g., wireless alarm sensors, and at least one receiver which (1) receives and demodulates the signals from the sensors and (2) performs various actions in accordance with the contents of the received transmissions, e.g., generating an alarm.

The system comprises RF front end circuitry for receiving the RF signal and down converting it to an IF or baseband signal. This signal is then demodulated to provide a receive data signal. In addition to the IF or baseband signal, the RF front end also generates an analog RSSI signal. This analog signal is converted to digital format by an A/D converter. The magnitude of the signal is input to an algorithm that functions to convert the magnitude to a number. In the case of a visual indicator, this number represents the number of flashes to be generated. In the case of an audible indicator, this number represents the number of beeps to be generated.

In one embodiment of the invention, the visual indicator may comprise a single LED or other light source such as an incandescent lamp. The audible indicator may comprise a beeper or piezo element. The digitized quantity to be indicated can be input to a microcontroller. The microcontroller can be suitably programmed with software which functions to convert the magnitude of the digitized quantity to a number representing the number of flashes or beeps, depending on the type of indicator used in the system. The analog quantity can be digitized by an external A/D converter or by an A/D converter integral with the microcontroller.

There is provided in accordance with the present invention an apparatus for indicating the magnitude of a numerical quantity represented as an input comprising indicating means for indicating the magnitude of the quantity via one or more consecutive annunciations, conversion means adapted to receive the input and determine a number corresponding to the magnitude of the input in accordance with the following equation $$\text{NUM_OF_ANNUN} = \text{INT}\left[\text{INPUT}\cdot\frac{\text{FULL_SCALE}}{\Delta}\right] + 1$$

where $\Delta$=MAX(INPUT)−MIN(INPUT),

NUM_OF_ANNUN=number of annunciations,

INPUT=the magnitude of the numerical quantity or value representing the quality to be indicated, FULL_SCALE=the highest number of annunciations corresponding to the maximum input or best quality, $\Delta$=the dynamic range of the input from minimum to maximum and means for annunciating the indicator means the number of times in consecutive fashion and in accordance with a predetermined duty cycle.

The indicator means may comprise audible indicator means such as a buzzer, piezo element or speaker. The indicator means may also comprise visual indicator means such as a light emitting diode (LED).

The apparatus further comprises means for performing analog signal processing of the input before being converted by the analog to digital converter means or means for digitally processing the output of the analog to digital converter means before being input to the conversion means.

There is also provided in accordance with the present invention a method of indicating reception quality based on the measurement of a quantity represented by an input, the method comprising the steps of providing indicating means for indicating the reception quality via one or more consecutive annunciations, calculating a number corresponding to the magnitude of the input in accordance with the following equation $$\text{NUM_OF_ANNUN} = \text{INT}\left[\text{INPUT}\cdot\frac{\text{FULL_SCALE}}{\Delta}\right] + 1$$

where

Δ=MAX(INPUT)−MIN(INPUT),\

NUM__OF__ANNUN=number of annunciations,

INPUT=the magnitude of the reception quality or value representing the quality to be indicated, FULL__SCALE=the highest number of annunciations corresponding to the maximum input or best quality, Δ=the dynamic range of the input from minimum to maximum and annunciating the indicator means the number of times in consecutive fashion and in accordance with a predetermined duty cycle.

The quantity representing the quality of reception is derived from an analog measurement or from a digital measurement.

BRIEF DESCRIPTION OF THE DRAWINGS

The invention is herein described, by way of example only, with reference to the accompanying drawings, wherein.

DETAILED DESCRIPTION OF THE INVENTION

Notation Used Throughout

Figure 1:
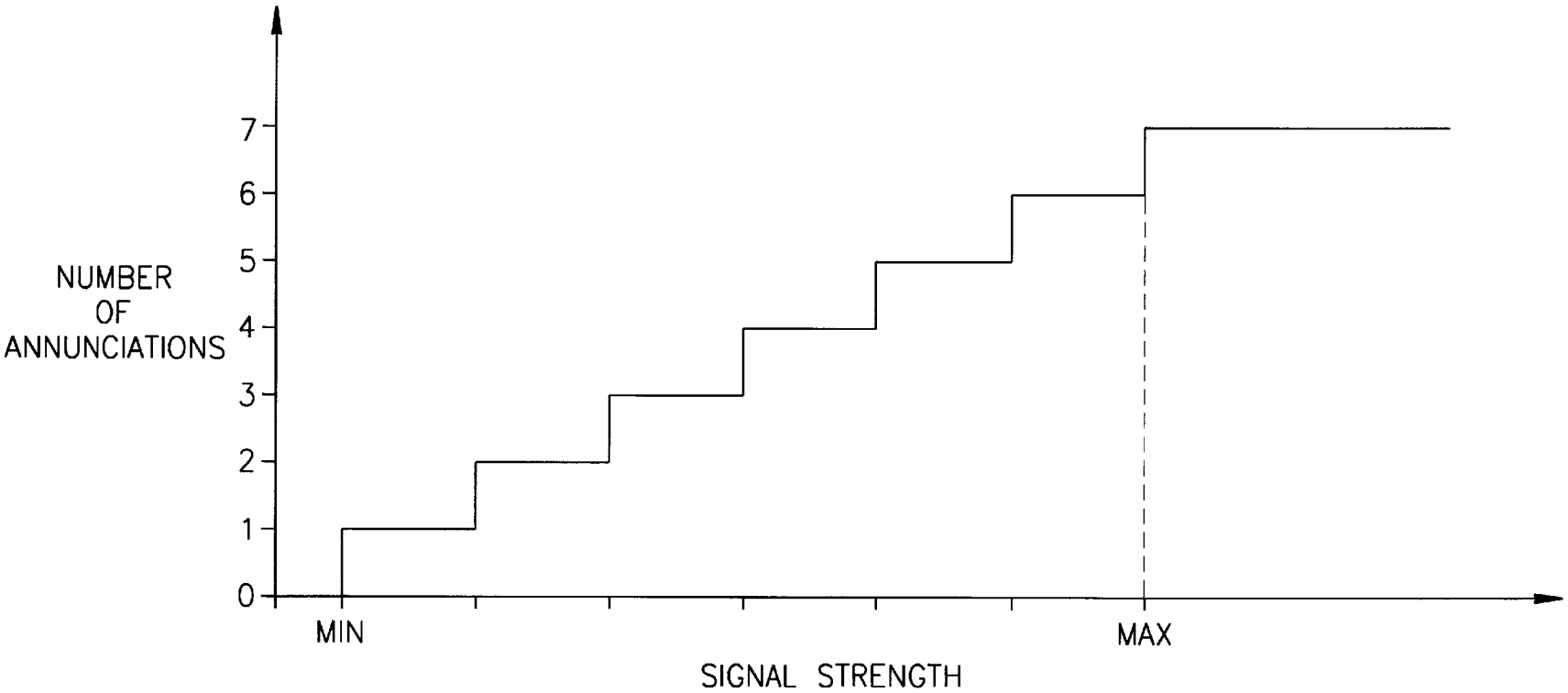
FIG. 1 is a graph illustrating the relation between the number of annunciations versus the magnitude of the signal to be indicated.

The following notation is used throughout this document.

| Term | Definition |
|---|---|
| CRC | Cyclic Redundancy Check |
| I/O | Input/Output |
| IF | Intermediate Frequency |
| LCD | Liquid Crystal Display |
| LED | Light Emitting Diode |
| RF | Radio Frequency |
| RSSI | Received Signal Strength Indicator |

General Description

The present invention is an apparatus for and a method of providing a visual and/or audible indication of a numerical quantity. The quantity may be derived from an analog or digital signal. The term numerical quantity is intended to include any numerical quantity in addition to a measure of quality. As stated previously, the principles of the present invention will be presented in the context of a wireless RF security alarm application. Note that this is not intended to limit the scope of the invention. One skilled in the art can apply the principles of the present invention to applications in the same or other fields as well, including but not limited to data communications, signal processing, bit error indication mechanism, weighted average error indication, signal strength indication, and any other quantity desired to be indicated.

The invention functions to convert a numerical quantity to a sequence of consecutive indications. The quantity may be derived, for example, from either an analog or digital signal. The number of indications annunciated is in direct relation to the magnitude of the quantity to be indicated. Two types of indicators are disclosed herein as examples: a visual indicator and an audible indicator. The visual may comprise an LED, LCD, lamp, bulb or any other suitable visual indicator means. The audible indicator may comprise a buzzer, beeper, piezo element, resonator, speaker or any other suitable audible indicator means.

For illustration purposes, the following description assumes an LED is used as the indicator means in the receiver portion of the wireless security system. Using an LED as the visual indicator means is advantageous in that it is relatively inexpensive to provide and is easily viewed from across a room. The LED, as used in this example, functions to provide an indication of valid signal reception. In particular, the LED provides an indication of the magnitude of the receive signal strength indication (RSSI) for a particular transmission.

Note, however, that the present invention is not limited to analog processing of link quality as described in further detail hereinbelow. The invention may be adapted to indicate the quality of an entity, i.e., quality measure, and not just the magnitude of a quantity, e.g., analog or digital. Although the term quantity is used extensively throughout this document, it is meant to also embody the quality of an entity as well as the magnitude of a quantity.

Alternative embodiments of the invention comprise digital and/or software means of determining link quality, such as through the use of forward error detection and correction, CRC, etc. The indication provided by such a system may be based on various methods of measuring link quality. More specifically, examples of digital determination means of link quality include but are not limited to counting parity errors on bytes received, CRC errors in data packets, regular bit errors in coded data, inconsistency of repeated data where a repetition code is used (retransmission of the same data several times) and a percentage of valid data received when a known amount of data has been sent (this may reflect the amount of interfered frequencies/channels in a frequency hopping link, for example). Note also that the invention can provide indications of reception quality in a receiver that is jammed or interfered.

Depending on the magnitude of the signal strength, the LED is flashed a certain number of times in quick succession. Thus, a mapping is created between the minimum and maximum of the signal to be indicated and the number of flashes. The graph shown in FIG. 1 illustrates the relation between the number of annunciations, i.e., flashes, versus the magnitude of the signal to be displayed. In this example, the maximum number of annunciations possible is seven representing the full scale value. Thus, the scale of possible signal strengths is divided into seven segments. Low signal strength values cause the LED to be flashed a fewer number of times and conversely, high signal strength values cause the LED to be flashed a larger number of times. If the signal strength is below the minimum, no annunciations are made.

Note that the y-axis represents the number of annunciations, e.g., flashes, beeps or other visible or audible indications. In addition, the graph illustrates clipping of the input signal to be indicated. Values of the signal strength, e.g., RSSI, greater than the maximum do not result in a number of flashes greater than seven. Thus, the input signal is clipped before being converted to a number of annunciations (flashes or beeps). Note that if a very weak signal is present (still representing a valid reception), the visual or audible indicator is annunciated at least once. If no valid signal is received, the visual or audible indicator will not be annunciated at all.

The indicator, e.g., LED, is annunciated a number of times in accordance with the magnitude of the signal strength received. The duty cycle for the annunciation is arbitrary but a typical duty cycle value is approximately 80 ms 'on' and 80 ms 'off' for each annunciation. The number of annunciations, e.g., LED flashes, is a function of the magnitude of the RSSI of that particular reception as generated by the analog circuit of the RF receiver (described in more detail infra).

In this example, the device is adapted such that one flash represents very weak reception, near the receiver's sensitivity threshold. An additional flash is added for each incremental amount of additional received signal strength, up to a limit of seven flashes corresponding to a reception which is exceptionally strong. For example, each incremental flash (or annunciation) may represent an additional 8 dB of received signal with the minimum being −95 dBm (a single annunciation) and the maximum being −47 dBm (seven annunciations).

Note that the LED can be made to flash any number of times, larger or smaller than seven. The number seven, however, is a reasonable compromise between resolution of the signal to be indicated and human perception. A larger number of flashes is possible but becomes more difficult to perceive.

The present invention allows a user or installer to quickly determine qualitatively the RSSI level for a particular transmitter without the requirement of expensive and complicated LED bar displays, complex LCD displays, multiple element displays, etc. The invention is particularly useful when the system is being installed and it is desired to first check the transmission path loss between the receiver base and each transmitter (sensor) or when it is desired to check the integrity of the system.

It provides an installer with a visual or audible indication means of the reception level quality of the RF transmission of a sensor being installed. Accordingly, the sensor can be moved a few centimeters in different directions while monitoring the indicator until the optimal point where the sensor should be placed is determined. The indicator also provides an indication of how close the reception level for this particular sensor is to the threshold of the receiver.

Figure 2:
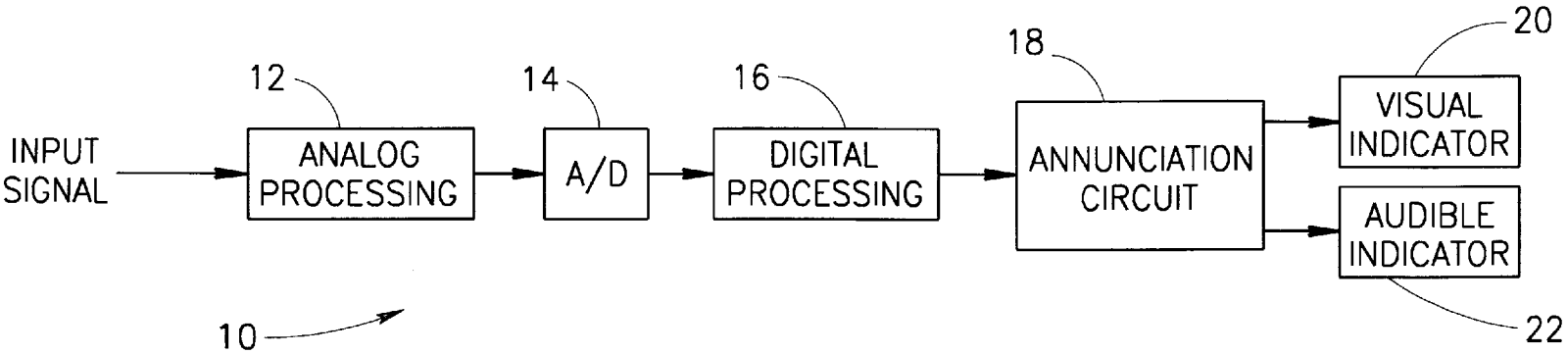
FIG. 2 is a block diagram illustrating a generalized indicating system of the present invention adapted to control a visual and/or an audible indicator.

A block diagram illustrating a generalized indicating system of the present invention adapted to control a visual and/or an audible indicator is shown in FIG. 2. The circuit, generally referenced 10, comprises an analog processor 12 for receiving the input signal whose magnitude is to be indicated. The analog processing circuit performs any required analog signal processing (if any) of the input signal. Such processing may include, for example, rectification, amplification, filtering, etc. The processing requirements typically vary with the characteristics of the input signal and the application.

The output of the analog processor 12 is converted to digital form via A/D converter 14. The output of the A/D converter is input to a digital processor 16. The digital processor performs any required digital signal processing (if any) of the digitized signal. Such processing may include, for example, filtering, scaling, calibration, linearization, etc. Here too, the processing requirements typically vary with the characteristics of the input signal and the application.

The output of the digital processor 16 is input to the annunciation circuit 18. The annunciation circuit 18 functions to convert the magnitude of the input signal into either a number of flashes or beeps, depending on the type of indicator used. The circuit can be adapted to provide a flash and/or beep signal to the visual indicator 20 or audible indicator 22, respectively. Alternatively, the processor 16 can be adapted to drive the visual and/or audible indicators 20, 22, directly.

Figure 3:
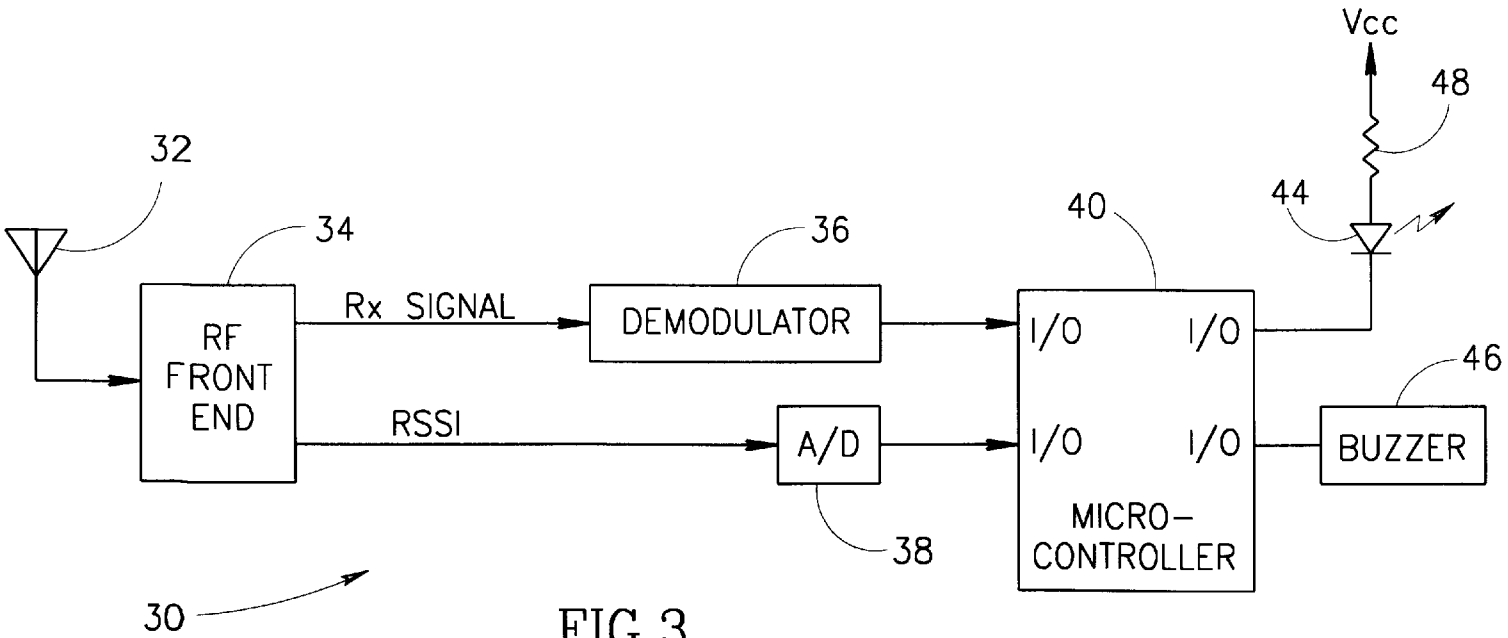
FIG. 3 is a block diagram illustrating an example of the indicating system constructed in accordance with the present invention and adapted for a wireless RF application.

A block diagram illustrating an example of the indicating system constructed in accordance with the present invention and adapted for a wireless RF application is shown in FIG. 3. The circuit, generally referenced 30, comprises an antenna 32 for receiving signals from one or more transmitters (not shown). Note that transmission events in this type of RF communication system are a relatively rare occurrence, e.g., once a second or once a minute, and are very short relative to the time lapses between two consecutive transmissions.

The signal from the antenna is input to an RF front end 34 which down converts the RF signal to an IF or baseband signal (denoted Rx signal) depending on the implementation. The RF front end functions to generate an RSSI signal in addition to the Rx signal.

The Rx signal is input to a demodulator 36 which demodulates the signal to a digital receive signal suitable for input to an I/O port on the processor 40. The processor 40 may comprise a microcontroller, microprocessor or any other suitable processing means. The RSSI signal, whose magnitude is to be indicated via a single LED, is converted to digital form via A/D converter 38. The digitized output of the A/D converter is input to an I/O port on the processor 40. Note that the A/D converter may be integral with the processor 40 as is the case of many microcontrollers available today.

Also connected to the processor are the visual indicator and an audible indicator. The visual indicator comprises an LED 44 whose cathode is connected to an I/O port and whose anode is connected to $V_{CC}$ via resistor 48. The audible indicator comprises a buzzer 46 connected to an I/O port of the processor 40. Note that the circuit may include either one or both of the two types of indicator, i.e., visual and audible.

The microcontroller 40, is suitably programmed with software that functions to convert the digitized input signal into a number of annunciations, i.e., flashes or beeps. The function used to perform the conversion is expressed below in Equation 1.

$$\text{NUM_OF_ANNUN} = \text{INT}\left[\text{INPUT}\cdot\frac{\text{FULL_SCALE}}{\Delta}\right] + 1 \tag{1}$$

where $$\Delta = \text{MAX(INPUT)} - \text{MIN(INPUT)} \tag{2}$$

and where

NUM_OF_ANNUN=the number of annunciations

INPUT=the magnitude of the input signal

FULL_SCALE=the highest number of annunciations (flashes or beeps) corresponding to the maximum input signal Δ=the dynamic range of the input signal from minimum to maximum Note that the number of flashes also represents the number of beeps in the case of audible indication means.

Figure 4:
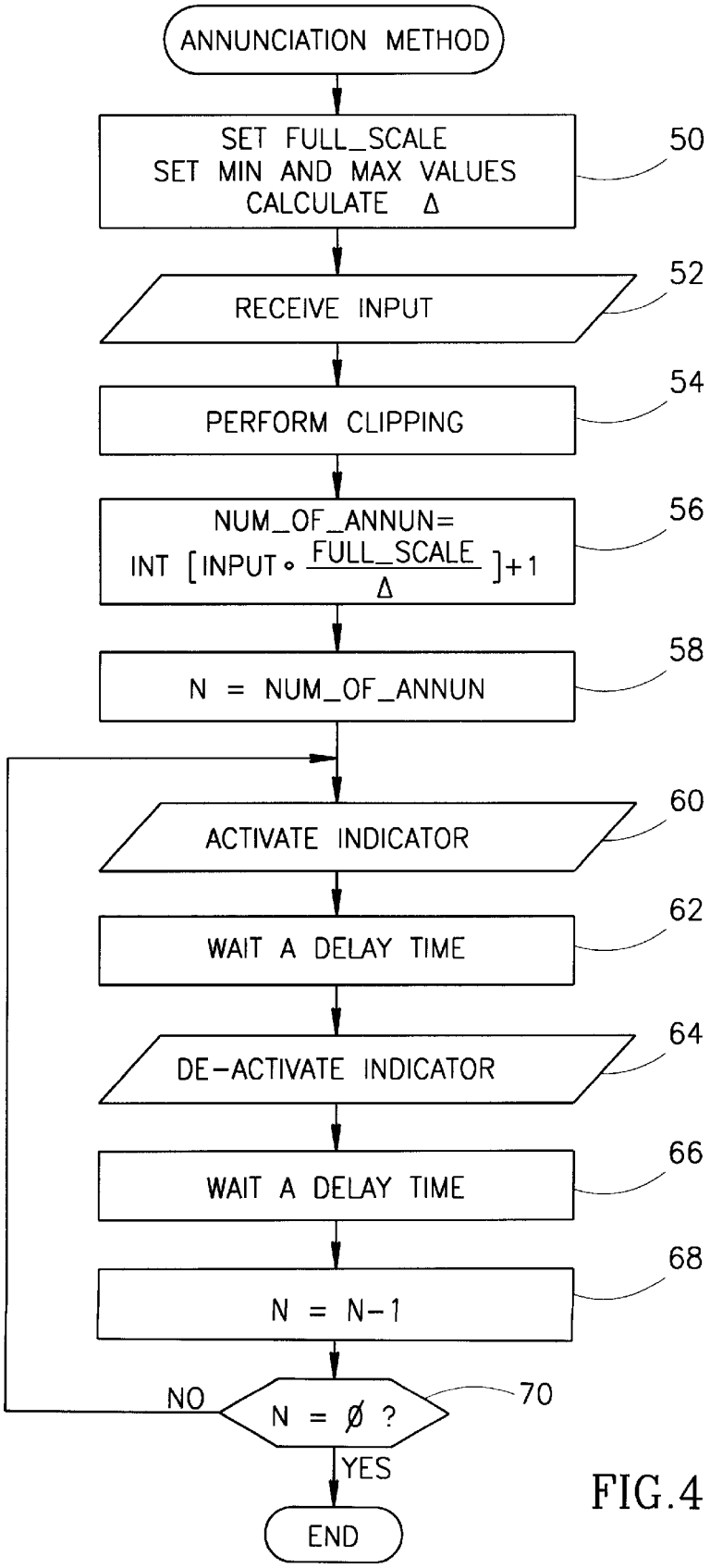
FIG. 4 is a logical flow diagram illustrating the annunciation method portion of the present invention.

A logical flow diagram illustrating the annunciation method portion of the present invention is shown in FIG. 4. Initially, the full scale value for the visual or audible indication means must be determined (step 50). In the example presented above this value was set to seven. In addition, the minimum and maximum values for the input signal are determined and the difference Δ is calculated. These only need to be determined once initially or when the input signal changes to one having different characteristics.

Next, the annunciation circuit, i.e., the processor, receives the input signal (step 52). Optional clipping is then performed (step 54). Clipping functions to compare the magnitude of the input signal to the maximum. The input signal is set to the maximum if it is greater than or equal to the maximum.

Then, the conversion from magnitude to number of annunciations (NUM_OF_ANNUN), i.e., flashes or beeps, is performed using the function of Equation 1 presented above (step 56). Once this is calculated, a loop is set up to flash or beep the indicator. First, a variable N is set to the number of annunciations, e.g., flashes or beeps (step 58). The visual and/or audible indicator is activated (step 60) followed by a predetermined delay time (step 62). This permits the user to see the visual indicator (or hear the audible indicator). Once the delay is complete, the indicator is then de-activated (step 64) followed by another delay time (step 66). Note that the ratio of the on and off delay times determine the duty cycle of the flashing. In the example above, the duty cycle was 50%, i.e., equal on and off times. The duty cycle can, however, be adjusted in accordance with the requirements of the application.

The variable N is then decremented by one (step 68). It is then checked whether N is equal to zero (step 70). If it is, the indication ends. If N is not equal to zero, control returns to step 60 and steps 60 to 70 are repeated until the loop terminates. In this fashion, the indicator is flashed or beeped a number of times corresponding to the magnitude of the input signal.

While the invention has been described with respect to a limited number of embodiments, it will be appreciated that many variations, modifications and other applications of the invention may be made.

What is claimed is:

1. An apparatus for indicating the magnitude of a numerical quantity, comprising:

indicating means adapted to indicate the magnitude of said quantity via one or more consecutive annunciations;

conversion means adapted to determine a number corresponding to the magnitude of said quantity in accordance with the following equation $$\text{NUM_OF_ANNUN} = \text{INT}\left[\text{INPUT}\cdot\frac{\text{FULL_SCALE}}{\Delta}\right] + 1$$

where

Δ=MAX(INPUT)−MIN(INPUT);

NUM_OF_ANNUN=number of annunciations;

INPUT=the magnitude of the numerical quantity or value representing the quality to be indicated;

FULL_SCALE=the highest number of annunciations corresponding to the maximum input or best quality;

Δ=the dynamic range of the input from minimum to maximum;

means for annunciating said indicator means a number of times corresponding to said NUM OF ANNUN value; and wherein said annunciations occur in consecutive fashion, with a predetermined duty cycle, and have a period that is independent of the magnitude of said quantity.

2. The apparatus according to claim 1, wherein said indicator means comprises visual indicator means.

3. The apparatus according to claim 2, wherein said visual indicator means comprises a light emitting diode (LED).

4. The apparatus according to claim 1, wherein said indicator means comprises audible indicator means.

5. The apparatus according to claim 4, wherein said audible indicator means comprises a buzzer.

6. The apparatus according to claim 4, wherein said audible indicator means comprises a piezo element.

7. The apparatus according to claim 4, wherein said audible indicator means comprises a speaker.

8. The apparatus according to claim 1, further comprising means for clipping said input to said maximum before conversion to said number.

9. The apparatus according to claim 1, wherein said conversion means comprises a suitably programmed microcontroller.

10. The apparatus according to claim 1, wherein said conversion means comprises a suitably programmed microprocessor.

11. An apparatus for indicating the magnitude of an analog quantity, comprising:

indicating means adapted to indicate the magnitude of said analog quantity via one or more consecutive annunciations;

analog to digital converter means for converting said analog quantity into a digital representation;

conversion means adapted to determine a number corresponding to the magnitude of said quantity in accordance with the following equation $$\text{NUM_OF_ANNUN} = \text{INT}\left[\text{INPUT}\cdot\frac{\text{FULL_SCALE}}{\Delta}\right] + 1$$

where

INPUT=the magnitude of said quantity;

Δ=MAX(INPUT)−MIN(INPUT);

NUM_OF_ANNUN=number of annunciations;

INPUT=the magnitude of the analog quantity or value representing the quality to be indicated;

FULL_SCALE=the highest number of annunciations corresponding to the maximum input or best quality;

Δ=the dynamic range of the input from minimum to maximum;

means for annunciating said indicator means a number of times corresponding to said NUM OF ANNUN value; and wherein said annunciations occur in consecutive fashion, with a predetermined duty cycle, and have a period that is independent of the magnitude of said quantity.

12. The apparatus according to claim 11, further comprising means for performing analog signal processing of said input before being converted by said analog to digital converter means.

13. The apparatus according to claim 11, further comprising means for digitally processing the output of said analog to digital converter means before being input to said conversion means.

14. The apparatus according to claim 11, wherein said indicator means comprises visual indicator means.

15. The apparatus according to claim 14, wherein said visual indicator means comprises a light emitting diode (LED).

16. The apparatus according to claim 11, wherein said indicator means comprises audible indicator means.

17. The apparatus according to claim 16, wherein said audible indicator means comprises a buzzer.

18. The apparatus according to claim 16, wherein said audible indicator means comprises a piezo element.

19. The apparatus according to claim 16, wherein said audible indicator means comprises a speaker.

20. The apparatus according to claim 11, further comprising means for clipping said input to said maximum before conversion to said number.

21. The apparatus according to claim 11, wherein said conversion means comprises a suitably programmed microcontroller.

22. The apparatus according to claim 11, wherein said conversion means comprises a suitably programmed microprocessor.

23. A method of indicating the magnitude of a numerical quantity, said method comprising the steps of:

providing indicating means for indicating the magnitude of said quantity via one or more consecutive annunciations;

calculating a number corresponding to the magnitude of said quantity in accordance with the following equation $$\text{NUM_OF_ANNUN} = \text{INT}\left[\text{INPUT}\cdot\frac{\text{FULL_SCALE}}{\Delta}\right] + 1$$

where

INPUT=the magnitude of said quantity;

Δ=MAX(INPUT)−MIN(INPUT);

NUM__OF__ANNUN=number of annunciations;

INPUT=the magnitude of the numerical quantity or value representing the quality to be indicated;

FULL__SCALE=the highest number of annunciations corresponding to the maximum input or best quality;

Δ=the dynamic range of the input from minimum to maximum;

annunciating said indicating means a number of times corresponding to said NUM OF ANNUN value; and wherein said annunciations occur in consecutive fashion, with a predetermined duty cycle, and have a period that is independent of the magnitude of said quantity.

24. A method of indicating reception quality based on the measurement of a quantity, said method comprising the steps of:

providing indicating means for indicating the reception quality via one or more consecutive annunciations;

calculating a number corresponding to the magnitude of said quantity in accordance with the following equation $$\text{NUM_OF_ANNUN} = \text{INT}\left[\text{INPUT}\cdot\frac{\text{FULL_SCALE}}{\Delta}\right] + 1$$

where $$\frac{\text{INPUT} = \text{the magnitude of said quantity;}}{\Delta = \text{MAX(INPUT)} - \text{MIN(INPUT);}}$$

NUM__OF__ANNUN=number of annunciations;

INPUT=the magnitude of the reception quality or value representing the quality to be indicated;

FULL__SCALE=the highest number of annunciations corresponding to the maximum input or best quality;

Δ=the dynamic range of the input from minimum to maximum;

annunciating said indicating means a number of times corresponding to said NUM OF ANNUN value; and wherein said annunciations occur in consecutive fashion, with a predetermined duty cycle, and have a period that is independent of the magnitude of said quantity.

25. The method according to claim 24, wherein said quantity representing the quality of reception is derived from an analog measurement.

26. The method according to claim 24, wherein said quantity representing the quality of reception is derived from a digital measurement.

* * * * *

UNITED STATES PATENT AND TRADEMARK OFFICE

CERTIFICATE OF CORRECTION

PATENT NO. : 6,127,936
DATED : October 3, 2000
INVENTOR(S) : Alon Gendel, et al.

It is certified that error appears in the above-identified patent and that said Letters Patent is hereby corrected as shown below:

On the title page:

In the "Assignee", [73], please correct to read:

--TEXAS INSTRUMENTS ISRAEL LTD. --

Signed and Sealed this

Eighth Day of May, 2001

*Attest:*

Nicholas P. Godici

NICHOLAS P. GODICI

*Attesting Officer*

*Acting Director of the United States Patent and Trademark Office*